US007800548B2

(12) United States Patent
Baginski et al.

(10) Patent No.: US 7,800,548 B2
(45) Date of Patent: Sep. 21, 2010

(54) INDUSTRIAL TRUCK WITH AT LEAST ONE ANTENNA FOR SENDING AND RECEIVING DATA

(75) Inventors: Ralf Baginski, Neetze (DE); Martin von Werder, Ammersbek (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 189 days.

(21) Appl. No.: 12/103,450

(22) Filed: Apr. 15, 2008

(65) Prior Publication Data

US 2009/0015494 A1 Jan. 15, 2009

(30) Foreign Application Priority Data

Jul. 11, 2007 (DE) ..... 10 2007 032 191

(51) Int. Cl.
*H01Q 1/32* (2006.01)
*H01Q 1/36* (2006.01)

(52) U.S. Cl. ..... 343/713; 343/897

(58) Field of Classification Search ..... 343/897, 343/711, 713, 873
See application file for complete search history.

(56) References Cited

U.S. PATENT DOCUMENTS

| | | | | |
|---|---|---|---|---|
| 2,063,531 | A * | 12/1936 | Tuttle | 343/713 |
| 2,129,766 | A * | 9/1938 | Hoskins | 343/713 |
| 4,370,658 | A * | 1/1983 | Hill | 343/713 |
| 6,933,891 | B2 * | 8/2005 | Lange | 343/700 MS |
| 7,151,979 | B2 * | 12/2006 | Andersen et al. | 700/214 |
| 2005/0272329 | A1 * | 12/2005 | Tueshaus et al. | 442/18 |
| 2006/0255954 | A1 | 11/2006 | Sorenson, Jr. et al. | |

FOREIGN PATENT DOCUMENTS

| | | | |
|---|---|---|---|
| DE | 1 710 203 | A1 | 4/2006 |
| WO | 03034360 | A1 | 4/2003 |
| WO | 03042916 | A1 | 5/2003 |
| WO | 2006094102 | A1 | 9/2006 |

* cited by examiner

*Primary Examiner*—Hoang V Nguyen
(74) *Attorney, Agent, or Firm*—Vidas, Arrett & Steinkraus, P.A.

(57) ABSTRACT

An industrial truck with at least one antenna for sending and receiving data from and/or to an RFID transponder, characterized in that the antenna has a network of wires, which are embedded in a flexible material.

11 Claims, 2 Drawing Sheets

INDUSTRIAL TRUCK WITH AT LEAST ONE ANTENNA FOR SENDING AND RECEIVING DATA

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to an industrial truck with at least one antenna for sending and receiving data from or to an RFID transponder.

In the field of logistics, there are numerous applications for RFID transponders, where RFID stands for Radio Frequency Identification Device. Possible application areas are, for example, the labeling of goods and/or products and the designation of storage positions and other special locations in a warehouse.

From EP 1 710 203 A1, the entire contents of which is incorporated herein by reference, an antenna for an RFID transponder is known which is fastened as a box-shaped plastic housing below and/or on the side of the fork support. Such an antenna can, for example, read out a transponder integrated in the loading support. However, a disadvantage of such an antenna turned out to be that they can be damaged easily in everyday use.

The objective of the invention is to provide an industrial truck with an antenna for RFID data that is suited reliably for continuous use without limitation of the visibility or the functionality of the industrial truck.

BRIEF SUMMARY OF THE INVENTION

The industrial truck according to the invention is equipped with at least one antenna for sending and receiving data from or to an RFID transponder. According to the invention, the antenna is composed of a network of wires, which are imbedded in a flexible material. The particular advantage of such an antenna consists in that the network of wires in the flexible material has a certain degree of flexibility and pliability, and therefore can not be damaged easily.

In a preferred construction, the flexible material is, in addition, formed transparent. This means that if the antenna is located in the field of view of an operator, an obstruction to visibility occurs only in a limited way. In particular, this has also proven to be an advantage if the antenna, due to its mounted position on the industrial truck, during its operation gets in the visual field of a driver for a short period or continuously.

In a preferred construction the wires in the network are linked together in a wire mesh. Depending on the frequency at which the data is sent and received with the antenna, the dimensions of the wire mesh are adapted to the frequency. Overall, the wire mesh forms an areal antenna, which has improved sending and receiving characteristics.

In a preferred further development, the wire mesh has at least two groups of wires, which run crosswise to each other. Such a wire mesh can, for example, have a rectangular shape, a square shape, or a rhombic shape. Because the wires in the wire mesh need not necessarily run in straight lines, the possibility exists for further geometric constructions of the wire mesh.

For the proper operation of the antenna, as a rule, a sending unit and/or a receiving unit is provided for the antenna. In addition, the mesh can preferably be embedded in the flexible material and provided with data and/or power via cables leading out from the flexible material.

Expediently, a transparent rubber material is provided as the flexible material. Alternatively to this, a transparent plastic material can also be used.

The antenna is preferably mounted in the front section of the industrial truck near the bottom. Preferably, the antenna is fastened to the load supporting means.

In a preferred construction, the antenna is mounted between the fork arms on the load carrier. Expediently, the mounted antenna hangs at least partially freely over the lower edge of the load carrier. It is also possible to mount the antenna on the vehicle body.

BRIEF DESCRIPTION OF THE SEVERAL VIEWS OF THE DRAWINGS

A preferred exemplary embodiment is explained in the following in more detail.

DETAILED DESCRIPTION OF THE INVENTION

Figure 1:
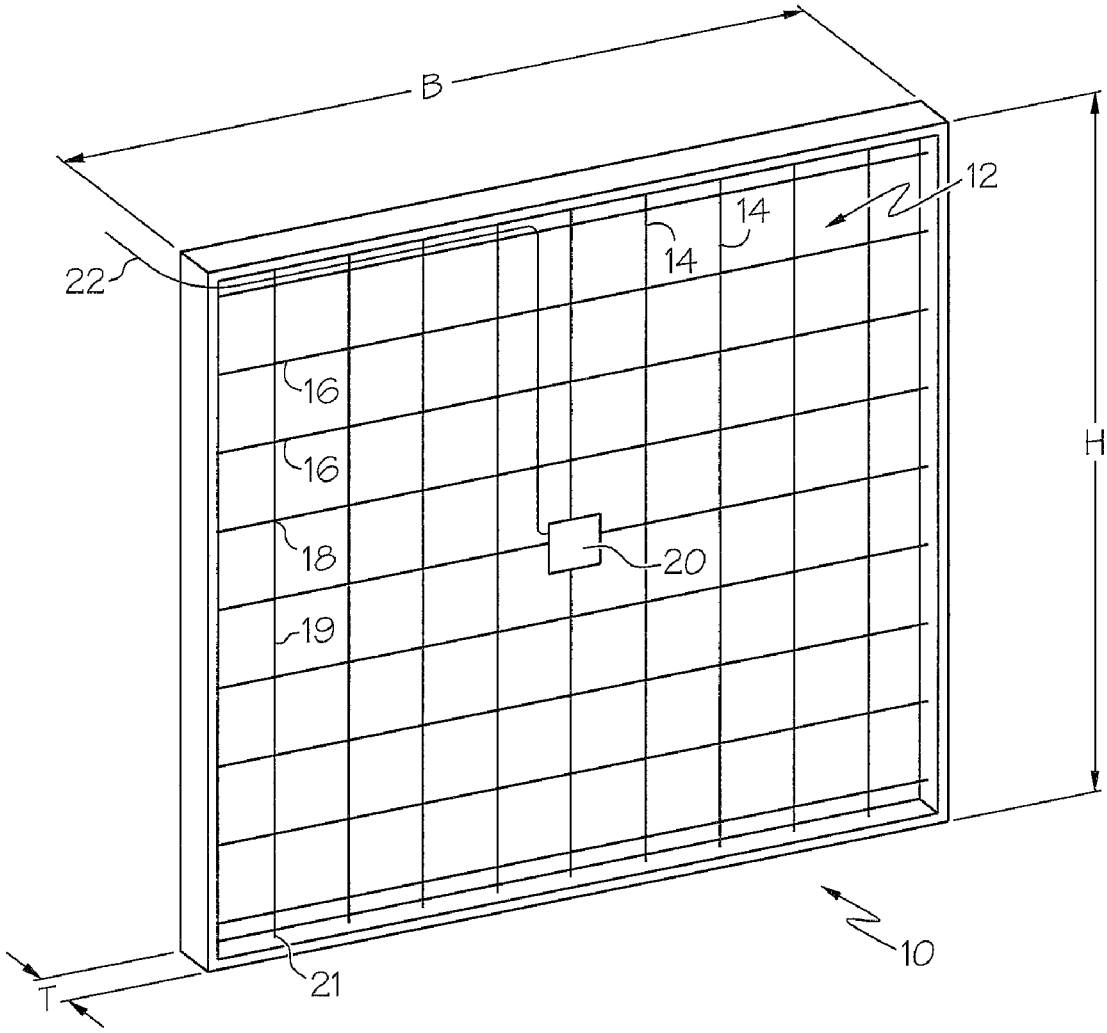
FIG. 1 shows an enlarged view of the antenna.

While this invention may be embodied in many different forms, there are described in detail herein a specific preferred embodiment of the invention. This description is an exemplification of the principles of the invention and is not intended to limit the invention to the particular embodiment illustrated FIG. 1 shows in a schematic view an antenna, which is constructed specially for receiving and sending data to RFID transponders. The represented antenna has essentially a rectangular construction with a width B and a height H. As can also be seen in the perspective representation, the antenna has a depth T. The antenna can have an essentially rectangular shape. In general, the depth T is significantly smaller than the dimensions in the width and height, such that the antenna overall has a high degree of flexibility and can yield in the case of impacts and contacts.

The antenna body 10 is composed of a transparent material which has a certain degree of flexibility. Transparent rubber material, for example, can be considered as a material, but transparent plastic material can also be used. The transparent material must not guarantee complete transparency. Also, a transparency that is clouded to some degree can be used with the antenna according to the invention.

It can be seen in FIG. 1 that the network 12 being used is composed of wires. In the represented example, the network 12 is composed of a first group of wires 14 running nearly parallel, which are arranged perpendicular to a second group of wires 16 running parallel. At the node points 18, the wires are conductively connected together. In order to guarantee a sufficient flexibility for the network 12 of wires 14 and 16, respectively, the individual wires 14, 16 can be composed of wire strands, interwoven together or otherwise connected.

Differing from the representation in FIG. 1, it is not necessary to construct the ends of the wires 14 and 16 as free ends. It is also conceivable that the ends of the wires are connected together electrically conductive, or are approximately flush with the corresponding wires running crosswise.

A sending and receiving unit 20 is provided in the center of the network 12. The sending and receiving unit is connected with additional devices in the periphery via a connection cable 22. The sending and receiving unit converts the data to be sent into control commands for the wires of the antenna. Preferably, detailed parameters of the antenna used and its wires are stored in the sending and receiving unit, such that the processing of the data by the sending and receiving unit can occur for the specific antenna.

Figure 2:
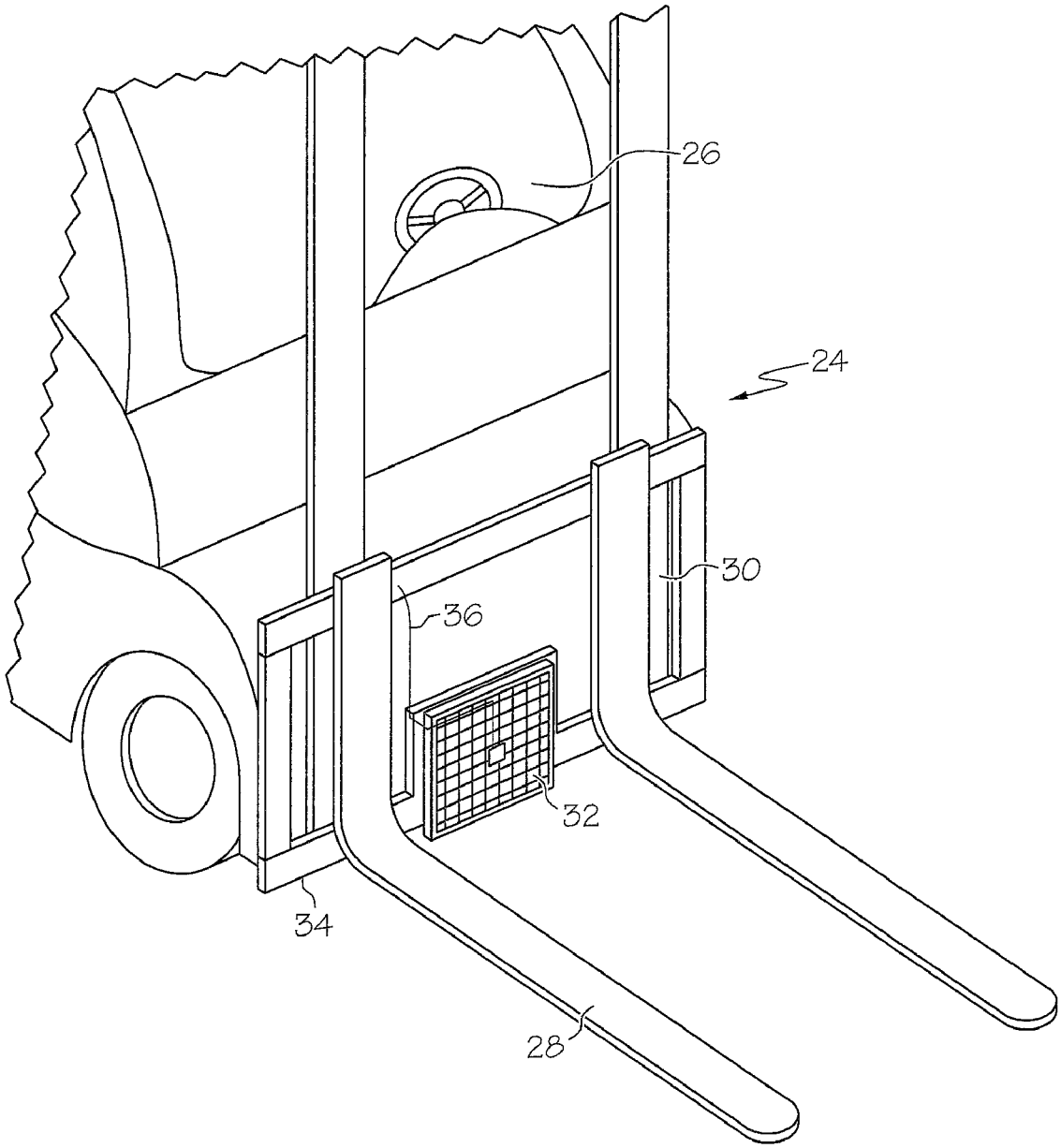
FIG. 2 shows the antenna mounted on the industrial truck.

FIG. 2 shows in a schematic view the front configuration of an industrial truck 24. A place for the driver 26 with a steering wheel can be recognized schematically. As a load support means, a load fork 28 is provided that projects from the front part of a lift frame 30. The antenna 32 according to the invention is arranged between the loading forks 28. The antenna 32 projects partly beyond the lower edge 34 of the lift frame. The antenna 32, due to its arrangement in the front part of the industrial truck, is occasionally also called an apron antenna. As is represented only schematically in FIG. 2, the antenna is connected via a cable 36 with a superordinate control unit, via which the signals for the RFID transponder can be read and evaluated.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. An industrial truck with at least one antenna for sending and receiving data from and/or to an RFID transponder, characterized in that the antenna has a network (12) of wires (14, 16), which are embedded in a flexible material (10).

2. The industrial truck according to claim 1, characterized in that the flexible material (10) is formed transparent.

3. The industrial truck according to claim 1, characterized in that the wires in the network (12) are linked together into a wire mesh.

4. The industrial truck according to claim 3, characterized in that the wire mesh has at least two groups (19, 21) of wires, which run crosswise to each other.

5. The industrial truck according to claim 1, characterized in that a receiving and/or sending unit (20) for the antenna is additionally embedded in the flexible material.

6. The industrial truck according to claim 1, characterized in that a transparent rubber material is provided as the flexible material.

7. The industrial truck according to claim 1, characterized in that a transparent plastic material is provided as the flexible material.

8. The industrial truck according to claim 1, characterized in that the antenna (32) is mounted in the front section of the industrial truck near the bottom.

9. The industrial truck according to claim 1, characterized in that the antenna (32) is mounted on a load support means.

10. The industrial truck according to claim 1, characterized in that the antenna (32) is mounted between the fork arms (28) on the load support (30).

11. The industrial truck according to claim 10, characterized in that the antenna (32) projects at least partly freely beyond the load support (30).

* * * * *